US005299439A

United States Patent [19]

Nelson et al.

[11] Patent Number: 5,299,439

[45] Date of Patent: * Apr. 5, 1994

[54] KEY HOLDER

[75] Inventors: Linden D. Nelson, 31535 Southfield Rd., Birmingham, Mich. 48009; Robert A. Scungio, West Warwick, R.I.

[73] Assignee: Linden D. Nelson, Birmingham, Mich.

[ * ] Notice: The portion of the term of this patent subsequent to May 11, 2010 has been disclaimed.

[21] Appl. No.: 830,584

[22] Filed: Feb. 6, 1992

Related U.S. Application Data

[63] Continuation-in-part of Ser. No. 675,724, Mar. 27, 1991, abandoned, which is a continuation of Ser. No. 470,765, Jan. 26, 1990, Pat. No. 5,031,430.

[51] Int. Cl.[5] ..... A47G 29/10

[52] U.S. Cl. ..... 70/456 R; 70/459

[58] Field of Search ..... 70/456 R, 459; D3/61, D3/62; 24/3 R, 234, 239, 371

[56] References Cited

U.S. PATENT DOCUMENTS

| | | | |
|---|---|---|---|
| 285,864 | 9/1986 | Sakai | D3/61 |
| 4,888,970 | 12/1989 | Kinzler et al. | 70/414 X |
| 4,944,171 | 7/1990 | Oliana | 70/458 X |
| 4,984,442 | 1/1991 | Benson | 70/459 X |
| 5,050,414 | 9/1991 | Huang | 70/459 X |
| 5,209,089 | 5/1993 | Nelson | 70/456 R |

FOREIGN PATENT DOCUMENTS 0088699 9/1983 European Pat. Off. .

*Primary Examiner*—Peter M. Cuomo
*Assistant Examiner*—Suzanne L. Dino
*Attorney, Agent, or Firm*—Spencer, Frank & Schneider

[57] ABSTRACT

A double ended key holder includes a first body portion, a second body portion, and joining and biasing mechanisms for engaging the first and second body portions together to form a key holder having openings on at least one end. The first body portion is configured to form one of the openings and has a gap which is hidden when the first and second body portions are biased together in an engaged position. The first and second body portions are joined for relative slidably movement between the engaged position and the open position 12 Claims, 3 Drawing Sheets

KEY HOLDER

CROSS-REFERENCE TO RELATED APPLICATIONS

The present application is a continuation-in-part of application Ser. No. 07/675,724, filed Mar. 27, 1991, a design application, which is a continuation of application Ser. No. 07/470,765, filed Jan. 26, 1990, a utility application, now U.S. Pat. No. 5,031,430.

FIELD OF THE INVENTION

The present invention relates to an improved key holder for retaining one or more keys on key rings. More specifically, this invention relates to a double ended key holder having improved means for detachably removing at least one key ring.

BACKGROUND OF THE INVENTION

Conventional double ended key holders typically support a pair of key rings that are located at opposite ends of a central housing. With such a key holder, keys desired to be retained on a single device may be segregated and placed on one of the key rings which is removably secured to the key holder. For example, automobile keys may be placed on one key ring, fastened to one end of the key holder, and house keys may be placed on a separate key ring fastened to the other end of the key holder. Examples of conventional double ended key holders are illustrated in MacDonald U.S. Pat. Nos. 271,443 of Nov. 22, 1983, and 285,987 of Oct. 7, 1986; Colan U.S. Pat. No. 306,799 of Mar. 27, 1990; Scungio U.S. Pat. Nos. 4,821,543 of Apr. 18, 1989 and 5,020,348 of Jun. 4, 1991; and Nelson U.S. Pat. No. 5,031,430 of Jul. 16, 1991. Each of the foregoing is hereby incorporated by reference.

SUMMARY OF THE INVENTION

It is an object of this invention to provide an improved key holder for at least one key ring, and preferably two key rings, one at each end of the key holder, where at least one of the key rings can be separated from the key holder. More particularly, this invention provides an improved key holder made of first and second body portions, each of which may have an associated key ring, where at least one of the key rings can be removed without interfering with the other key ring. Thus, for example, if a house key and an automobile key are placed on separate rings on the same key holder, such as with the key rings on opposite ends of the key holder, the automobile key may be easily removed from the key holder to remain with the automobile when the automobile is taken to a service station, automobile dealer or the like, while the house key may remain on the key holder and thus retained in the possession of the owner.

A further object of the invention is to provide a key holder having opposed key rings where one of the key rings is retained in an opening formed between the first and second body portions when they are biased into an engaged position. Force exerted on one of the body portions relative to the other body portion will overcome the bias force such that a key ring may be removed.

Another object of this invention is to provide a biasing means for a key holder of the type having first and second body portions which are slidably engaged to move laterally, relative to each other, between engaged and open positions, where the biasing means is for sliding the first and second body portions into the engaged position.

According to one embodiment of the present invention, a double ended key holder is provided comprising a first body portion having a lower surface and an elongated opening for receiving a key ring; a second body portion having an upper surface; means for joining the first and second body portions together, the joined body portions being slidable between an engaged position and an open position; and means for biasing the first and second body portions into the engaged position with the upper surface of the second body portion mating with the lower surface of the first body portion. When a force of sufficient magnitude is applied opposite to the biasing means, the first and second body portions are slidably moved relative to each other, from the engaged position to the open position, which exposes the elongated opening and permits the removal of key rings from the key holder (or the mounting of key rings on the key holder).

A further object of the present invention is to provide means for retaining a second key ring on the key holder. Optionally, a second key ring may be mounted to freely rotate or swivel.

An additional object of the present invention is to provide a key holder which is simple and inexpensive to manufacture.

BRIEF DESCRIPTION OF THE DRAWINGS

The various objects of the present invention, together with other advantages and benefits which may be attained by its use, will become more apparent upon reading the following detailed description of the invention taken in conjunction with the drawings. In the drawings, wherein like reference numerals identify corresponding portions of the various embodiments of the key holder.

DETAILED DESCRIPTION OF THE INVENTION

Figure 1:
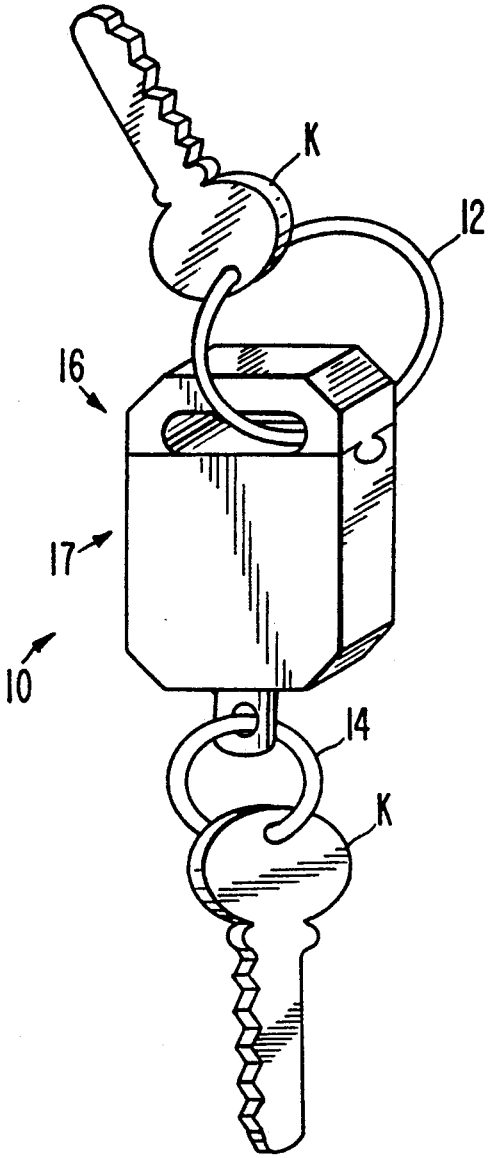
FIG. 1 is a front pictorial view of the key holder of the present invention, in the engaged position, illustrating the optional provision of two key rings with at least one key on each key ring.
Figure 2:
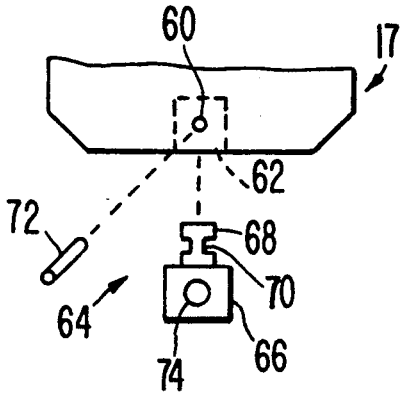
FIG. 2 is a front elevation view of a portion of the key holder of FIG. 1, with FIG. 2 being partially exploded for illustrative purposes.
Figure 3:
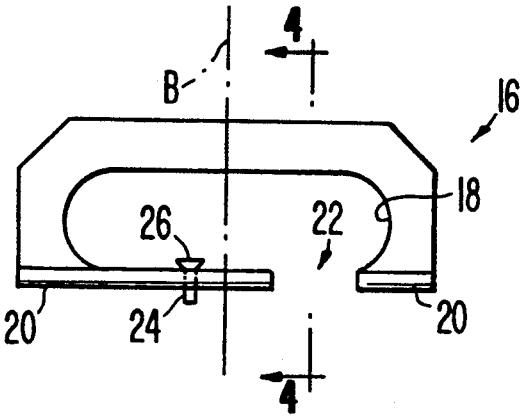
FIG. 3 is an enlarged, front elevation view of a first portion of the key holder of FIG. 1.

Referring first to FIG. 1 of the drawings, a double ended key holder 10 has openings at opposite ends to receive one or more key rings 12, 14, each of which may contain one or more keys K. In the embodiment of FIG. 1 the key holder 10 is illustrated as including a first body portion 16 (further illustrated in FIGS. 3, 4 and 8) and a second body portion 17 (further illustrated in FIGS. 2 and 5 through 8).

The first body portion 16 is configured generally as a thin rectangular plate having a hollow interior or opening 18. The first body portion includes a convex or bulbous bottom surface 20. A gap 22 is provided completely through the bottom surface 20 to permit access to the hollow interior or opening 18. When the key holder body portions are in the closed or engaged position, the gap 22 is concealed from view, as shown in FIG. 1. Thus, a first key ring 12 retaining a key K can be attached through gap 22 and into opening 18 and is retained by key holder 10 when the body portions are in the engaged position The first body portion 16 has an axis B defined as a vertical axis relative to the orientation of the key holder in FIGS. 1 and 2. It should be noted that nomenclature such as first and second, right and left, front and back, upper and lower, top and bottom, etc., is solely for illustrative purposes and should not be taken as limiting the present invention.

The bottom surface 20 of the first body portion has, in addition to gap 22, a small hole therethrough with a pin 24 or protuberance extending vertically through the hole, the pin may be attached or secured to the first body portion such as by flaring the top portion 26 of the pin outwardly in the nature of a rivet. The flared top of the pin is on the interior of the opening 18. In the illustrated embodiment, the bottom surface 20 is aligned generally perpendicular to the axis B, gap 22 is offset laterally in a first direction from the center of the first body portion, as viewed in FIG. 2, and the pin 24 extends parallel to the axis B and is offset laterally in a second direction, opposite to said first direction, from the center of the first body portion as viewed in FIG. 2. As will be described further, the pin functions as part of a joining means for enabling the connection between the first and second body portions to be maintained.

Figure 5:
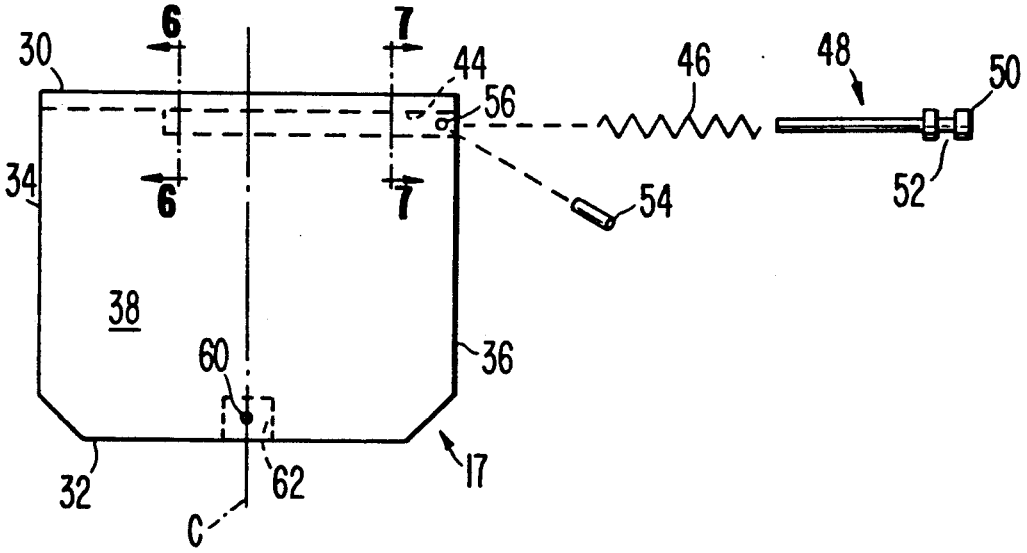
FIG. 5 is an enlarged, front elevation view of a second portion of the key holder of FIG. 1, with FIG. 5 being partially exploded for illustrative purposes.

Referring next to FIGS. 1, 2, and 5–8, the second body portion 17 is generally configured as a thin, rectangular or square plate or housing and includes an axis C which is defined as a vertical axis relative to the orientation of the key holder in FIGS. 1 and 5. The second body portion 17 has top and bottom surfaces 30, 32, respectively, left and right sides 34, 36, respectively, and front and rear faces 38, 40, respectively. The upper surface 30 of the second body portion is provided with a concave portion, such as a groove 42, configured complementary (in cross-section) to the bulbous portion 20 of the first body portion, such that the lower surface of the first body portion and the upper surface of the second body portion are mating, i.e., the parts may be engaged and relative sliding movement may be achieved.

Figure 7:
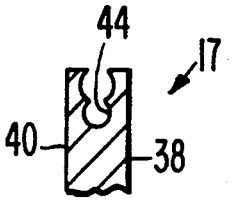
FIG. 7 is a sectional view as seen in the direction of arrows 7—7 of FIG. 5.
Figure 8:
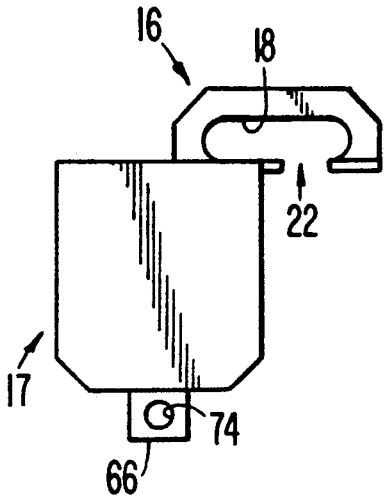
FIG. 8 is a front elevation view of the key holder of the present invention in the open position.

A bore extends partially through the second body portion 17, such as from the right side 36 toward the left side 34, just below the groove 42. The bore, which is preferably of circular cross-section, extends approximately two-thirds of the width of the second body portion 17, and the top of the bore opens into the bottom of the groove 42, as illustrated in FIG. 7. The bore 44 and the groove 42 are parallel to each other and perpendicular to the axis C.

A biasing means is illustrated in FIG. 5 for maintaining the key holder in a closed or engaged position. Specifically, a spring 46 and an elongated rod 48 of circular cross-section are provided for the bore 44. The diameter of the spring is greater than the width of the intersection or junction between bore 44 and groove 42 such that the spring is retained within bore 44. Rod 48 includes, at one end, an enlarged head 50, with a circumferential groove 52 spaced inwardly from the end of the head. The elongated rod may be inserted into the spring 46. With the rod and spring in position in the bore 44, a small pin 54 is force fit through a suitable aperture 56 in the front face 38 of the second body portion. The aperture is located such that as the pin is forced into the aperture, the pin will engaged the reduced diameter groove 52 in the enlarged head of the rod 48. This retains the rod and spring within the bore.

The biasing means cooperates with the joining means for connecting and maintaining the body portions together. In the illustrated example, before the spring is inserted into the bore 44, the bottom surface 20 of the first body portion is aligned to engage the groove 42 of the second body portion, with the first body portion positioned to the right of the second body portion when viewed in the orientation of FIGS. 3 and 5. The two body portions are slid, relative to each other, such that surface 20 functions as a key and groove 42 functions as a keyway. Pin 24 extends through groove 42 into the bore 44. As the first and second body portions are slid together, the interior end of the groove 44 functions as a stop to limit the sliding movement of the first and second body portions (in one direction) and may thus define the closed or engaged position. Then, the spring and rod may be inserted into the bore 44 and the pin 54 inserted to maintain the rod and spring in position. The length of the spring is determined such that the spring exerts a biasing force on pin 24 to prevent accidental movement of the first body portion to the right, relative to the second body portion, as viewed in the orientation of FIGS. 1, 3 and 5.

It may be appreciated that with the first and second body portions is the engaged or closed position, as illustrated in FIG. 1, the gap 22 is concealed and any key ring 12 extending through the opening 18 may not be removed. The bias force is sufficient to prevent accidental sliding of the first and second body portions, relative to each other, to prevent the gap 22 from being exposed.

The second body portion includes a small aperture 60, adjacent the bottom 32 and positioned along the central axis C. A bore 62 extends from the bottom 32 a short distance inwardly along axis C and the aperture 60 is in communication with the bore 62. As illustrated in greater detail in FIG. 2, an elongated rod 64 is provided, having an enlarged head 66 at one end, of greater diameter than the bore 62, and an enlarged head 68 of smaller diameter than the bore 62 at the other end. A circumferential groove 70 is provided in the enlarged head 68. The rod 64, and more particularly the enlarged head 68 is inserted into the bore 62 and a pin 72 is force fit through aperture 60 and into the circumferential groove 70. This connection provides for rotational mounting of the rod 64 relative to the second body portion. A hole 74 is bored through the enlarged head 66, positioned exteriorly of the second body portion, such that a second key ring 14 may be inserted through the hole 74.

The operation of the key holder will now be explained. The first and second body portions 16, 17 are pulled apart by a force exerted generally perpendicular to the aligned axes B, C. The force overcomes the biasing means and causes spring 46 to be compressed as the first and second body portions slide, relative to each other. When the first and second body portions have been slid a sufficient distance, with the bottom surface 20 and groove 42 still engaged, the key holder may be considered to be in the open position with gap 22 exposed such that a key ring 12 may easily be attached to or removed from the first body portion. Thereafter, the first and second body portions may be released, and then the first and second body portions, and more particularly the mating surfaces 20, 42 slide toward the closed or engaged position under the influence of the biasing means.

It should be appreciated that in lieu of a key rings having keys thereon, an actual key may be engaged with the first body portion.

Figure 9:
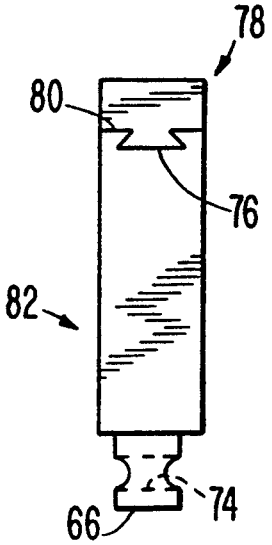
FIG. 9 is a side elevation view of another embodiment of the key holder of the present invention.
Figure 4:
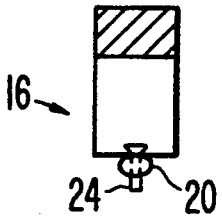
FIG. 4 is a sectional view as seen in the direction of arrows 4—4 of FIG. 3.
Figure 6:
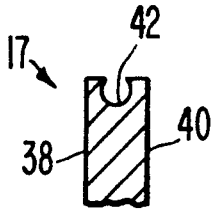
FIG. 6 is a sectional view as seen in the direction of arrows 6—6 of FIG. 5.

Another aspect of the present key holder will now be described. Referring to FIGS. 4 and 6, it may be seen that the key and keyway of the first and second body portions of the key holder are of generally circular cross-section. FIG. 9 illustrates an alternate embodiment where the key and keyway are of a dovetail configuration. Specifically, the lower surface 76 of the first body portion 78 is configured as a tenon or wedge and the upper surface 80 of the second body portion 82 is configured as a complementary mortise or groove.

Figure 10:
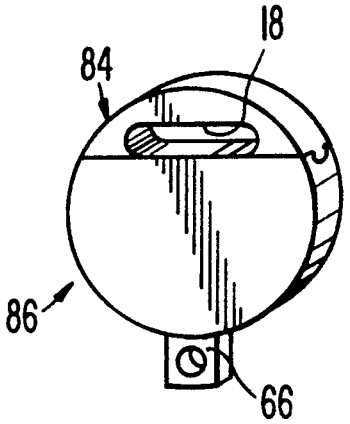
FIG. 10 is a front elevation view of another embodiment of the key holder of the present invention.

Another aspect of the present invention is the overall configuration of the key holder. The key holder illustrated in FIGS. 1–9 is generally of square or rectangular configuration when viewed from the front. The principles of the present invention may be applied to a key holder of generally circular shape, when viewed from the front, as seen in FIG. 10 where the first and second body portions are identified by reference numerals 84 and 86 respectively.

Figure 11:
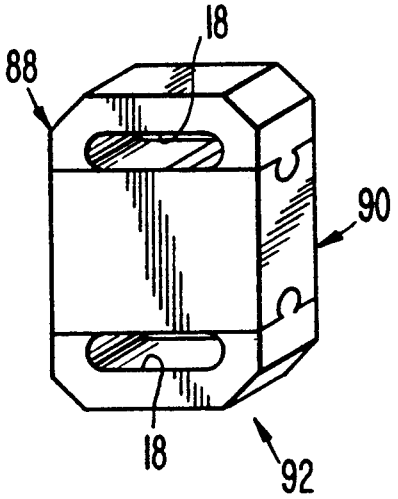
FIG. 11 is a front elevation view of another embodiment of the key holder of the present invention.

Yet another aspect of the present invention is the provision of a three-part body for the key holder, identified by reference numerals 88, 90 and 92. Applying the principles of the present invention, body portion 88 corresponds to the first body portion 16 of FIGS. 1–8 (or first body portion 78 of FIG. 9 or first body portion 84 of FIG. 10 in that the first body portion 88 includes an opening to receive a key ring. The first body portion is slidably mounted at one end of body portion 90. Another body portion 92, which is based on the same principles of the present invention and may be a duplication of body portion 88 yet inverted as to orientation, is slidably mounted at the other end of body portion 90. Thus the body portion 90 will include a second biasing means, mounted in a separate bore, at the second or lower body end (in the orientation illustrated in FIG. 11). Hence the embodiment of FIG. 11 provides for slidably releasable key rings on opposite ends of a key holder. When utilizing the benefits of the embodiment of FIG. 11, it may be appreciated that the configuration of the key holder as viewed from the front may be square, rectangular, round, oval, etc.

In all embodiments the spring is preferably stainless steel and the other components are brass. After the key holder is assembled, conventional metal finishing is employed such as sanding (tumbling) polishing and decorative plating. The key holder can also be made of other strong or rigid material, such as plastics, wood, etc. The first and second body portions may be formed through a casting, machining or molding operation. The second body portion may be embossed with a trademark or logo of an automobile manufacturer or other decorative designs.

The foregoing is a complete description of the present invention. The scope of the invention should only be limited by the following claims.

What is claimed is:

1. A key holder comprising:

a first body portion;

a second body portion;

said key holder having opposed first and second ends;

said first body portion and said second body portion having an engaged position and an open position;

said first and second body portions being secured together for relative sliding movement transversely of said first and second ends, between said engaged position and said open position;

said first body portion having an opening therethrough for retaining a key ring at said first end, and an access to said opening;

said access being closed when said body portions are in said engaged position to prevent removal of a key ring, the relative sliding movement of said first and second body portions into said open position for exposing said access to permit removal of key ring; and means for biasing said first and second body portions into said engaged position.

2. The invention as defined in claim 1 wherein said first body portion has a first surface and said second body portion has first surface, said first surfaces being configured complementary to each other.

3. The invention as defined in claim 2 wherein one of said first surfaces forms a keyway for the other of said first surfaces.

4. The invention as defined in claim 2, wherein said first surface of said second body portion forms a keyway for the first surface of said first body portion.

5. The invention as defined in claim 1, wherein said second body portion includes means for retaining a second key ring at said second end.

6. The invention as defined in claim 5, wherein said second key retaining means is mounted for rotational movement relative to said second body portion.

7. The invention as defined in claim 1, wherein said biasing means includes a spring mounted in the second body portion.

8. The invention as defined in claim 1 wherein the access is a gap in the first surface of the first body portion, said gap being concealed when the first and second body portions are in the engaged position.

9. The invention as defined in claim 1, wherein the key holder is of generally rectangular configuration.

10. The invention as defined in claim 9, wherein the key holder is of generally circular configuration.

11. The invention as defined in claim 1, wherein one of the body portions includes a bore and the other of said body portions includes a protuberance engaging said bore, the bore including an interior end for limiting the relative sliding movement of the first and second body portions.

12. The invention as defined in claim 1, wherein the key holder includes a third body portion;

said third body portion and said second body portion having an engaged position and an open position;

said third and second body portions being secured together for relative sliding movement between said engaged position and said open position;

said third body portion having an opening therethrough for retaining a key ring and an access to said opening;

said access being closed when said second and third body portions are in said engaged position to prevent removal of a key ring, the movement into said open position for exposing said access to permit removal of a key ring; and means for biasing said third and second body portions into said engaged position.

* * * * *